United States Patent [19]

Hally

[11] 4,235,438

[45] Nov. 25, 1980

[54] PINBALL GAME SPINNING TARGET

[75] Inventor: Michael L. Hally, Santa Clara, Calif.

[73] Assignee: Atari, Inc., Sunnyvale, Calif.

[21] Appl. No.: 18,491

[22] Filed: Mar. 8, 1979

[51] Int. Cl.[3] ..... A63B 67/14

[52] U.S. Cl. ..... 273/127 D; 273/121 A; 273/DIG. 26

[58] Field of Search ..... 273/127 R, 127 D, 85 C, 273/14, 101, 119 R, 119 A, 122 R, 122 A, 86 G, 37, 38, 102.1 E, 102.2 R, 181 R, 181 V, 102 AP; 200/61.11; 35/19 R; 46/63, 51, 50; 280/217

[56] References Cited

U.S. PATENT DOCUMENTS

| | | | |
|---|---|---|---|
| 3,237,965 | 3/1966 | Asano | 280/217 |
| 3,430,959 | 3/1969 | Ross et al. | 273/127 D |
| 3,854,728 | 12/1974 | Brandell | 273/127 D |

FOREIGN PATENT DOCUMENTS

| | | | |
|---|---|---|---|
| 593161 | 5/1959 | Italy | 273/119 A |
| 68071 | 7/1944 | Norway . | |

*Primary Examiner*—Richard C. Pinkham
*Assistant Examiner*—T. Brown
*Attorney, Agent, or Firm*—Townsend and Townsend

[57] ABSTRACT

The present invention provides a spinning target which is accurately responsive to the force of impact of a pinball on the target. A generally flat target element is suspended above the playfield so that it is rotatable about an axis parallel to the playfield and sufficiently above the field so that the pinball can pass below when the target element is in a horizontal configuration. The target element has a principal axis of inertia generally coincident with the axis of rotation of the target element. The target element is biased so that it is maintained in a vertical configuration until impacted by the pinball. A pair of weights which have a mass density relatively greater than the mass density of the target element are embedded in the target element in its respective extremities. The weights are symmetrically disposed relative to and remote from the principal axis of the target element. The target element together with the weights has a relatively high moment of inertia to sustain rotation of the target element proportionate to the force of impact of the pinball on the target element. The number of revolutions of the target element are tabulated to provide a score which is proportional to the force of impact of the pinball on the target.

7 Claims, 2 Drawing Figures

PINBALL GAME SPINNING TARGET

BACKGROUND OF THE INVENTION

The present invention relates to an improved target for use in pinball machines, and in particular to a spinning target which is responsive to the force of impact of the pinball on the target.

Pinball games in which a solid metal ball moves randomly about a flat playfield have been in common use for years. Various targets are located on the playfield, and points are scored as the pinball impacts the targets. Manually operated devices such as plungers and flippers are used to keep the ball in play, and the object of the game is to obtain as high a score as possible by impacting as many targets as possible before the pinball leaves the playfield.

As a general rule, the targets used in such pinball machines register a score based solely upon a count of the number of impacts on the various targets, with the different targets having varying point values, and no attempt is made to gauge the force of impact on the target for scoring purposes. Examples of such targets are found in U.S. Pat. No. 3,430,959 to Ross et al., in which a flat target is rotated through an arc of nearly 180° against stop, and U.S. Pat. No. 3,452,988 to Zale, in which a wire gate is flipped open. A wide variety of other such targets are known in the art.

U.S. Pat. No. 3,627,318 to Garbary et al illustrates a device in which a lever target is used to determine score based upon the force of impact of the pinball on the target. However, as is evident from a cursory review of this patent, devices of the Garbary type are complex relative to standard pinball technology, and are not commonly used.

Attempts have been made in the past to use a spinning target in which the number of revolutions of the target, based upon the force of impact of the pinball on the target, is used to determine the score. Unfortunately, such targets as used in the past have a relatively low moment of inertia about their axis of rotation because they are constructed of homogeneous molded plastic, even if they have a dumbell cross-section which increases the amount of inertia to some extent. This low moment of inertia renders the targets highly subject to frictional forces, and such targets cannot be relied upon to provide consistent scoring, particularly when the device becomes worn through use. Also, many such devices have eccentric weights, rendering them even further subject to the vagaries of frictional forces.

SUMMARY OF THE INVENTION

The present invention provides a spinning target which is accurately responsive to the force of impact of a pinball on the target. A generally flat target element is suspended above the playfield so that it is rotatable about an axis parallel to the playfield and sufficiently above the field so that the pinball can pass below when the target element is in a horizontal attitude. The target element has a principal axis of inertia generally coincident with the axis of rotation of the target element. The target element is biased so that it is maintained in a vertical configuration until impacted by the pinball.

A pair of weights which have a mass density relatively greater than the mass density of the target element are embedded in the target element at its respective extremities. The weights are symetrically disposed relative to and remote from the principal axis of the target element. The target element together with the weights has a relatively high moment of inertia to sustain rotation of the target element proportionate to the force of impact of the pinball on the target element. The number of revolutions of the target element is tabulated to provide a score which is proportional to the force of impact of the pinball on the target.

The target element of the present invention with its embedded weights has a zero product of inertia about its rotational axis because its principal axis is coincident with it axis of rotation. In other words, there are no eccentric forces on the target element when it rotates, minimizing the effect of friction on the rotation of the target element. In addition, the weights provide the target element with a relatively high moment of inertia about its rotational axis, which also minimizes the effect of friction on the rotation of the target element. As a result of these two factors, the target element provides an effective, repeatable response proportionate (not necessarily linearly) to the impact of the pinball on the target for scoring purposes, which is not subject to significant degradation over the lifetime of the device.

In the preferred embodiment of the present invention, the target element is mounted to a rod which has a crank portion in a plane parallel to the plane of the target element. An armature is suspended from the crank portion of the rod and the weight of the armature biases the target element into its normally vertical attitude. The armature is connected to a switch which measures the number of revolutions of the rod for scoring. This system not only provides a convenient scoring mechanism, but also a mechanism for maintaining the target in its vertical configuration without imposing significant eccentric loads on the supporting mechanism which would result in undesirable frictional effects.

The novel features which are characteristic of the invention, as to organization and method of operation, together with further objects and advantages thereof will be better understood from the following description considered in connection with the accompanied drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
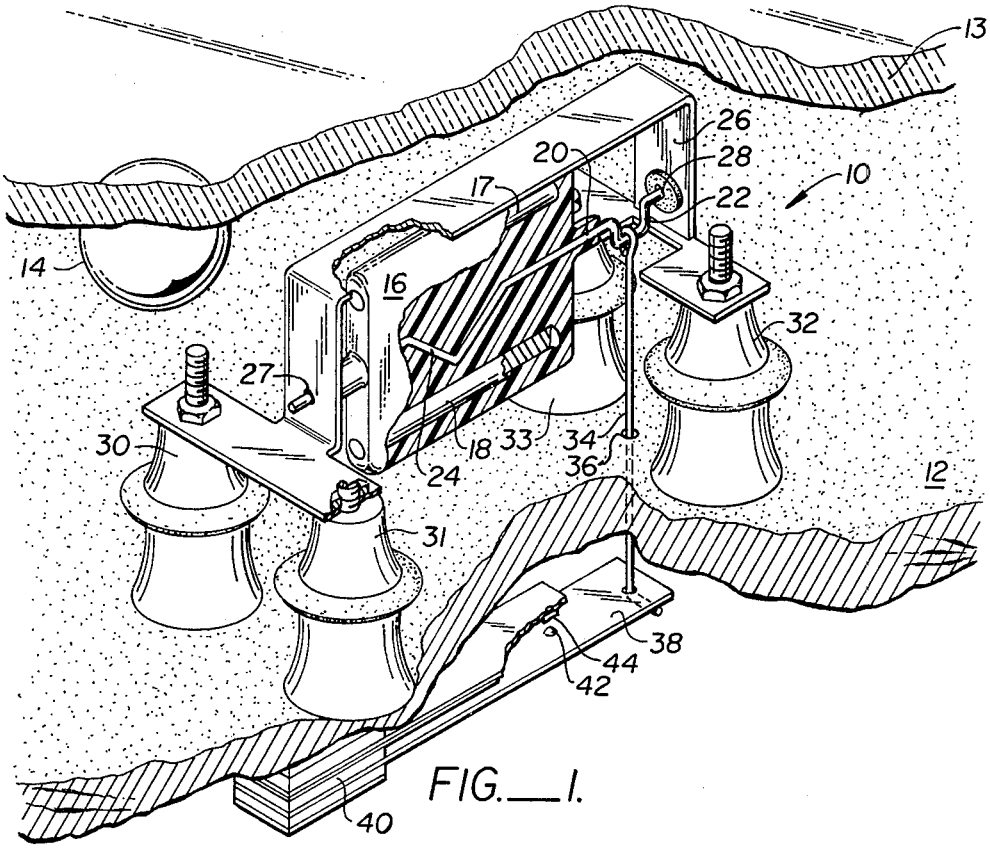
FIG. 1 is a perspective, partially cutaway view of the preferred embodiment of the spinning target of the present invention.
Figure 2:
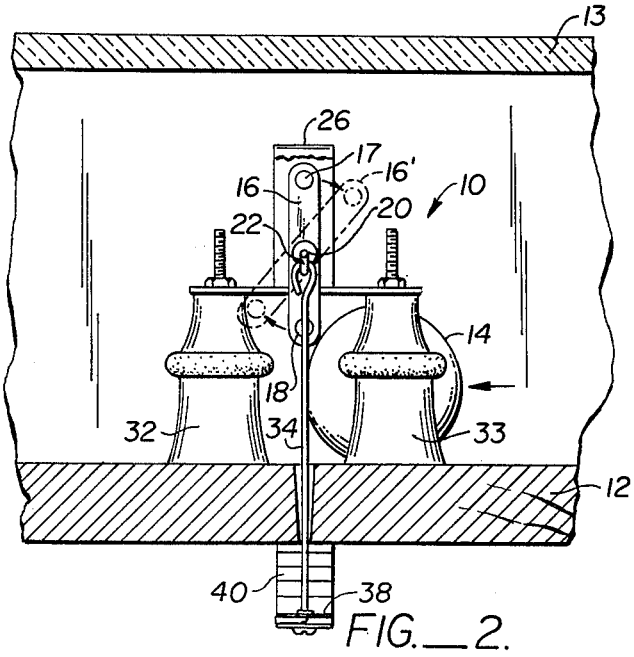
FIG. 2 is a side elevation view of the embodiment of FIG. 1 with portions cutaway.

The preferred embodiment 10 of the target of the present invention is illustrated by way of reference to FIGS. 1 and 2 in combination. Target 10 is mounted to a playfield 12 of a pinball game beneath a glass cover 13. A pinball 14 moves about playfield 12 and impacts targets such as 10 which produce a score.

Target 10 of the present invention includes a flat target element 16 suspended above playfield 12. Target element 16 is constructed of plastic material, but contains a pair of relatively heavy metal cylindrical weights 17, 18 embedded in the body of the target element.

Target element 16 is nonrotatably mounted to a rod 20. Rod 20 includes a crank portion 22 at one end to the side of target element 16. In order to insure that target element 16 is nonrotatable relative to rod 20, rod 20 may be provided with a bent portion 24 within the target element.

Rod 20 is suspended above playfield 12 by a frame 26. Rod 20 passes through apertures 27, 28 so that the rod is freely rotatable. Apertures 27, 28 are located sufficiently above playfield 12 to allow pinball 14 to pass beneath target element 16 and rod 20 when the target element is in its horizontal position.

Frame 26 is mounted on two or more bumpers 30–33, which are in turn fixed to playfield 12. As illustrated, bumpers 30–33 are solid and not used for scoring purposes.

An armature 34 is suspended from the crank portion 22 of rod 20. Armature 34 passes through a hole 36 formed in playfield 12, and is connected to a blade element 38 of blade switch 40. When target element 16 is at rest, the weight of armature 34 on the crank portion 22 of rod 20 biases target element 16 into a vertical configuration, as illustrated in FIG. 1. When pinball 14 impacts the target element, it rotates, as illustrated by 16' in FIG. 2. Each rotation of crank portion 22 of rod 20 lifts armature 34 and blade element 38 so that a contact 42 on the blade element touches a second contact 44 on switch 40, closing the switch. Each closure of switch 40 counts for scoring purposes, and thus, the scoring is proportionate to the number of rotations of target element 16.

Target element 16 is symmetric about its axis of rotation so that its product of inertia about the rotational axis is zero, i.e., there is no eccentricity in its weight distribution about its axis of rotation. Any eccentricity caused by the bent portion 24 of rod 20 is insignificant. Accordingly, the axis of rotation of target element 16 constitutes a principal axis of the target element. The advantage of this feature is that eccentric loads are not imposed upon the support for the target element when it rotates, minimizing friction losses.

Weights 17, 18 are symmetrically disposed about the axis of rotation of target element 16. These metal weights have a mass density far in excess of the plastic target element, and their location at the extremities of the target element gives the target element a high polar moment of inertia about its axis of rotation. This feature also minimizes the effects of friction on the rotation of the target element, and the rotation of the target element is directly related to the force of impact of pinball 14 on the target element.

While a preferred embodiment of the present invention has been illustrated in detail, it is apparent that modifications and adaptations of that embodiment will occur to those skilled in the art. However, it is to be expressly understood that such modifications and adaptations are within the spirit and scope of the present invention, as set forth in the following claims.

What is claimed is:

1. A target for use in a game in which a pinball traverses a flat playfield, said target comprising:

a rod suspended above the playfield and having a crank portion at one end, said rod being freely rotatable about an axis parallel to the playfield and sufficiently above the playfield for the pinball to pass below the axis of rotation of the rod;

a generally flat target element nonrotatably mounted to said rod and rotatable therewith and having a principal axis of inertia generally coincident with the axis of rotation of the target element and the rod so that the product of inertia of the target element about said principal axis is substantially zero, the plane of the target element being coincident with that of the crank portion of the rod;

an armature depending from the crank portion of the rod to bias the target element so that it is maintained in a vertical attitude until impacted by the pinball;

a pair of weights having a mass density relatively greater than the mass density of the target element, said weights being embedded in the target element in its respective extremities remote from said principal axis so that the target element together with the weights has a relatively high moment of inertia about the axis of rotation of the target element to sustain rotation proportionate to the force of impact of the pinball on the target element; and means for tabulating the number of revolutions of the target element when impacted by the pinball for scoring purposes.

2. A target as recited in claim 1 and additionally comprising a pair of spaced apart support members fixed to the playfield, and wherein the rod is rotatably mounted to said support members.

3. A target as recited in claim 1 wherein the tabulating means comprises a switch actuated by the armature upon each rotation of the target element.

4. A target as recited in claim 1 wherein the target element is constructed of a plastic material, and wherein the weights each comprise a cylindrical metal element having an axis parallel to the axis of rotation of the target element.

5. A target for use in a game in which a pinball traverses a flat playfield, said target comprising:

a pair of spaced apart support members fixed to the playfield;

a rod rotatably mounted to the support members so that the rod spans the support members and is freely rotatable about an axis parallel to the playfield sufficiently above the playfield for the pinball to pass below the axis of rotation of the rod between the support members, said rod including a crank portion proximate one end of the rod;

a generally flat target element nonrotatably mounted to said rod so that the plane of the target is coincident with the plane of the crank portion of the rod, said target element being rotatable with the rod and having a principal axis of inertia generally coincident with the axis of rotation of the target element and the rod;

a pair of cylindrical metal weights having a mass density relatively greater than the mass density of the target element, said cylindrical weights being embedded in the target element in its respective extremities parallel to and remote from said principal axis so that the target element together with the weights has a relatively high moment of inertia about the axis of rotation of the target element to sustain rotation proportionate to the force of impact of the pinball on the target element;

an armature depending from the crank portion of the rod, the weight of said armature biasing the target element into a vertical configuration until impacted by the pinball; and a switch actuated by the armature upon each rotation of the target element, the actuation of said switch being used for scoring purposes.

6. A target as recited in claim 1 or 5 wherein the peripheral dimensions of the target element are generally rectangular.

7. A target as recited in claim 1 or 5 wherein the rod has a bent portion internal to the target element to enhance the nonrotatable connection between the target element and the rod.

* * * * *